US007766003B2

(12) United States Patent
Kim et al.

(10) Patent No.: US 7,766,003 B2
(45) Date of Patent: Aug. 3, 2010

(54) COOKING APPARATUS AND METHOD FOR CONTROLLING THE SAME

(75) Inventors: Tae Woo Kim, Busan (KR); Seok Weon Hong, Yongin-si (KR); Jong Chull Shon, Suwon-si (KR); Hyang Ki Kim, Suwon-si (KR); Jeong Han Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 68 days.

(21) Appl. No.: 12/155,757

(22) Filed: Jun. 9, 2008

(65) Prior Publication Data

US 2009/0090347 A1 Apr. 9, 2009

(30) Foreign Application Priority Data

Oct. 9, 2007 (KR) ..... 10-2007-0101205

(51) Int. Cl.
*A21B 1/24* (2006.01)
*A21B 1/22* (2006.01)
*A21B 1/26* (2006.01)

(52) U.S. Cl. ..... 126/21 A; 126/19 R; 126/21 R; 126/273 R; 126/337 R; 99/330; 99/474; 219/400

(58) Field of Classification Search ..... 126/19 R, 126/21 A, 21 R, 273, 337 R; 99/330, 468, 99/474, 475, 476; 219/394, 440
See application file for complete search history.

(56) References Cited

U.S. PATENT DOCUMENTS 4,357,522 A * 11/1982 Husslein et al. ..... 219/400
5,468,935 A * 11/1995 Wang ..... 219/400
5,811,768 A * 9/1998 Choi et al. ..... 219/704
6,570,136 B1 * 5/2003 Lockwood et al. ..... 219/398
6,933,477 B2 * 8/2005 Becker et al. ..... 219/506
7,087,863 B1 * 8/2006 Kim et al. ..... 219/394
7,671,301 B2 * 3/2010 Elkasevic ..... 219/407
2002/0060215 A1 * 5/2002 Allera et al. ..... 219/394
2006/0006163 A1 * 1/2006 Carbone et al. ..... 219/400
2006/0027559 A1 * 2/2006 Kim et al. ..... 219/400
2006/0131298 A1 * 6/2006 Seuk Oh ..... 219/400
2006/0137675 A1 * 6/2006 Kim et al. ..... 126/21 A
2006/0196495 A1 * 9/2006 Kim et al. ..... 126/198
2006/0237428 A1 * 10/2006 Cho et al. ..... 219/401
2006/0278214 A1 * 12/2006 Park et al. ..... 126/273 R
2007/0012307 A1 * 1/2007 Wiker et al. ..... 126/21 A
2007/0039488 A1 * 2/2007 Hunter et al. ..... 99/476
2007/0062513 A1 * 3/2007 Gagas ..... 126/299 D
2007/0107712 A1 * 5/2007 Shiraichi et al. ..... 126/21 A
2007/0137633 A1 * 6/2007 McFadden ..... 126/21 A (Continued)

FOREIGN PATENT DOCUMENTS

DE 10313916 A1 * 10/2004

(Continued)

*Primary Examiner*—Steven B McAllister
*Assistant Examiner*—Daniel E Namay
(74) *Attorney, Agent, or Firm*—Staas & Halsey LLP

(57) ABSTRACT

A cooking apparatus to change the direction of hot air to be fed into a cooking chamber. The cooking apparatus includes a cooking chamber, a hot-air feeder to feed hot air into the cooking chamber, and an air-direction regulator to change a direction of the hot air fed from the hot-air feeder.

18 Claims, 13 Drawing Sheets

U.S. PATENT DOCUMENTS

| | | | | |
|---|---|---|---|---|
| 2007/0215608 | A1 * | 9/2007 | Yoshino et al. | 219/681 |
| 2008/0308545 | A1 * | 12/2008 | Kim et al. | 219/400 |
| 2009/0078291 | A1 * | 3/2009 | Kang et al. | 134/22.1 |
| 2009/0194092 | A1 * | 8/2009 | Shon et al. | 126/273 R |
| 2010/0072188 | A1 * | 3/2010 | Lee et al. | 219/393 |

FOREIGN PATENT DOCUMENTS

| | | | |
|---|---|---|---|
| EP | 1306623 | A2 * | 5/2003 |
| EP | 1437552 | A1 * | 7/2004 |
| EP | 1731842 | A2 * | 12/2006 |
| EP | 1731843 | A2 * | 12/2006 |
| FR | 2682560 | A1 * | 4/1993 |
| JP | 56020937 | A * | 2/1981 |
| JP | 56020938 | A * | 2/1981 |
| JP | 63131927 | A * | 6/1988 |
| JP | 04370053 | A * | 12/1992 |
| JP | 2002122328 | A * | 4/2002 |
| KR | 10-2006-0044217 | | 5/2006 |
| KR | 10-2006-0108796 | | 10/2006 |
| WO | WO 03036174 | A1 * | 5/2003 |

* cited by examiner (a)

(b)

COOKING APPARATUS AND METHOD FOR CONTROLLING THE SAME

CROSS-REFERENCE TO RELATED APPLICATIONS

This application claims the benefit of Korean Patent Application No. 2007-0101205, filed on Oct. 9, 2007 in the Korean Intellectual Property Office, the disclosure of which is incorporated herein by reference.

BACKGROUND

1. Field

The present invention relates to a cooking apparatus and a method for controlling the same, and, more particularly, to a cooking apparatus to cook an object to be cooked, etc. by use of a blowing fan, and a method for controlling the same.

2. Description of the Related Art

In general, a conventional convection type cooking apparatus includes a heater, an oven cavity providing a space in which food is cooked using heat emitted from the heater, a blowing fan disposed in the oven cavity to circulate air inside the oven cavity by convection, convection suction and discharge holes mainly provided at a rear surface of the cavity to suction or discharge the air circulated by rotations of the blowing fan, and at least one tray to support the food thereon so as to locate the food in a cooking chamber.

In operation of the above conventional cooking apparatus, if a user puts food into the oven cavity and inputs a cooking command, the blowing fan is operated to suction the air inside the cavity such that the suctioned air is heated by the heater, and then, operated to discharge the heated air into the cavity. As the air is forcibly circulated by operation of the blowing fan, the food can continuously come into contact with the high-temperature air to receive heat therefrom, thereby being cooked by the heat.

One example of the conventional cooking apparatus is disclosed in Korean Patent Laid-open Publication No. 10-2006-0108796 (hereinafter, referred to as a "first publication").

As one example of the conventional cooking apparatus, a convection oven disclosed in the above first publication is devised to allow hot air to move uniformly within a cooking chamber, so as to achieve a uniform temperature distribution in the cooking chamber and high heat-transfer efficiency. The disclosed convection oven includes: a cooking chamber in which food is cooked; a rack provided in the cooking chamber to put the food thereon; a convection heater and fan unit to feed and circulate hot air into the cooking chamber; a convection chamber enclosing the convection heater and fan unit to move the hot air into the cooking chamber; and a duct installed separately from the convection chamber to guide the hot air from the convection chamber into the cooking chamber.

In the invention disclosed in the first publication, the duct connected with the convection chamber is installed at a side surface of the cooking chamber to allow the hot air to move uniformly into the cooking chamber even when a single heating source is used. However, since the duct to feed the hot air into the cooking chamber is installed to the cooking chamber at a fixed position, the hot air creates a confined air stream, resulting in a limit to the uniform movement of the hot air in the cooking chamber.

Further, although it is necessary during a cooking operation to keep the cooking chamber at a uniform temperature or to heat a predetermined local region of the cooking chamber, according to an object to be cooked, the invention disclosed in the first publication has no function of changing the direction of hot air fed into the cooking chamber and cannot control the temperature distribution of the cooking chamber.

Furthermore, the invention of the first publication discloses only a single cooking chamber. Accordingly, since the overall cooking chamber should be heated even when only a small amount of food is cooked, there is a problem of a long cooking time and excessive consumption of electric power.

Another example of the conventional cooking apparatus is disclosed in Korean Patent Laid-open Publication No. 10-2006-0044217 (hereinafter, referred to as a "second publication").

As another example of the conventional cooking apparatus, a cooking apparatus disclosed in the above second publication includes a body having a cooking chamber, a door to open or close the cooking chamber, a heater unit provided in the body to heat the cooking chamber, a partition detachably provided in the cooking chamber to divide the cooking chamber into a first cooking chamber and a second cooking chamber, and a mode selecting unit to select any one of a single cooking mode using a single cooking chamber having no partition and a double cooking mode using double cooking chambers divided by the partition.

With the above described configuration, when a small amount of food relative to the volume of a cooking space will be cooked, the cooking apparatus disclosed in the second publication employs the partition to divide the cooking chamber into upper and lower cooking chambers, so as to selectively use only a selected cooking chamber. This reduces a cooking time and the consumption of electric power, and allows the upper and lower cooking chambers to be independently operated at different temperatures from each other.

Although the invention disclosed in the second publication can solve problems of the first publication to some extent, it needs to provide a heater and a blowing fan in each of the first and second cooking chambers separated from each other by the partition, resulting in very high manufacturing costs.

Further, since the invention disclosed in the second publication still has no function of changing the direction of hot air to be fed into the cooking chamber, it cannot control the temperature distribution of the cooking chamber similar to the invention of the first publication. That is, even when it is necessary upon a cooking operation to keep the cooking chamber at a uniform temperature or to heat a predetermined local region of the cooking chamber, according to the volume or characteristics of an object to be cooked, the invention disclosed in the second publication cannot satisfy this requirement.

SUMMARY

Accordingly, it is an aspect of the invention to provide a cooking apparatus capable of changing the direction of air to be fed into a cooking chamber.

It is a further aspect of the invention to provide a cooking apparatus and a method for controlling the same, wherein a plurality of cooking spaces can be selectively heated even by use of the same heating source, or can be controlled to have different temperatures from one another.

It is another aspect of the invention to provide a cooking apparatus and a method for controlling the same, wherein hot air is fed into a predetermined local region of a cooking space, or the overall cooking space can achieve a uniform temperature distribution.

It is yet another aspect of the invention to provide a cooking apparatus and a method for controlling the same, wherein the opening degree of a discharge hole can be controlled, to adjust the flow-rate and direction of air to be fed into a cooking chamber.

Additional aspects and/or advantages of the invention will be set forth in part in the description which follows and, in part, will be apparent from the description, or may be learned by practice of the invention.

In accordance with one aspect of the invention, the above and/or other aspects can be achieved by the provision of a cooking apparatus including: a cooking chamber; a hot-air feeder to feed hot air into the cooking chamber; and at least one air-direction regulator to change a direction of the hot air fed from the hot-air feeder.

The hot-air feeder may include a fan cover having a discharge hole, and the air-direction regulator includes an air-direction regulating member provided at the discharge hole and a drive unit to rotatably operate the air-direction regulating member.

The air-direction regulating member may close the discharge hole, or may be rotated by a predetermined angle under operation of the drive unit so as to regulate a discharge angle of the hot air to be discharged from the discharge hole.

The air-direction regulating member may include a pair of opening/closing portions corresponding to the discharge hole so as to close the discharge hole, and a variable discharge portion provided between the opening/closing portions to communicate the inside and the outside of the fan cover with each other.

The air-direction regulating member may have a blade shape.

The drive unit may include a drive motor to generate a drive force, a first gear provided at one end of the air-direction regulating member, and a second gear provided at a rotating shaft of the drive motor so as to be engaged with the first gear.

The air-direction regulator may have an operating mode including a concentrative discharge mode to concentrate the hot air fed from the hot-air feeder to a specific region in the cooking chamber and a dispersive discharge mode to widely disperse the hot air in the cooking chamber.

The cooking apparatus may further include: a sensing unit to sense a position of an object to be cooked in the cooking chamber, and the air-direction regulator may concentrate the direction of the hot air to the position of the object sensed by the sensing unit.

The cooking apparatus may further include: an input unit to input a user's command or the kind of an object to be cooked, and the operating mode of the air-direction regulator may be manually determined by a user's input operation, or may be automatically determined according to the kind of the object to be cooked.

The dispersive discharge mode may include a variable dispersive discharge mode to cause turbulent flows in the cooking chamber by changing a hot air feeding position.

The hot-air feeder may include a plurality of discharge holes, and the at least one air-direction regulator may include a plurality of air-direction regulators provided at the plurality of discharge holes, respectively, and the plurality of air-direction regulators may independently change a hot air feeding direction, to further cause turbulent flows in the cooking chamber.

The cooking apparatus may further include: a display unit to display the operating mode of the air-direction regulator.

In accordance with another aspect of the present invention, there is provided a cooking apparatus including: a cooking chamber; a divider to divide the cooking chamber into a plurality of cooking spaces; a hot-air feeder having a fan cover formed with a plurality of discharge holes to feed hot air into each of the plurality of cooking spaces; an air-direction regulator to change a direction of the hot air to be discharged from the plurality of discharge holes; and a control unit to control the air-direction regulator, so as to close the plurality of discharge holes, or to regulate the direction of the hot air to be discharged.

The plurality of cooking spaces may include first and second cooking chambers, and the air-direction regulator may include an upper air-direction regulator to change the direction of the hot air to be discharged into the first cooking chamber, and a lower air-direction regulator to change the direction of the hot air to be discharged into the second cooking chamber.

The control unit may control the respective upper and lower air-direction regulators independently.

The control unit may control one of the upper and lower air-direction regulators, to prevent the hot air from being discharged into one of the first and second cooking chambers, to which no cooking command is inputted, when a cooking command is inputted to the other cooking chamber.

In accordance with yet another aspect of the present invention, there is provided a method for controlling a cooking apparatus including a cooking chamber, a hot-air feeder to feed hot air into the cooking chamber, and an air-direction regulator to change a direction of the hot air, the method including: determining an operating mode based on inputted cooking information; and regulating the direction of the hot air discharged from the hot-air feeder based on the operating mode.

The method may further include: sensing a position of an object to be cooked in the cooking chamber if the operating mode corresponds to a concentrative discharge mode to concentrate the hot air to a predetermined region; and if the position of the object to be cooked is sensed, concentrating the hot air discharged from the hot-air feeder to the sensed position of the object to be cooked by use of the air-direction regulator.

The method may further include: if the operating mode corresponds to a dispersive discharge mode to achieve a uniform temperature distribution in the cooking chamber, uniformly dispersing the hot air discharged from the hot-air feeder into the cooking chamber by use of the hot-air regulator.

The method may further include: displaying whether the interior of the cooking chamber is in the concentrative discharge mode or in the dispersive discharge mode by operation of the air-direction regulator.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
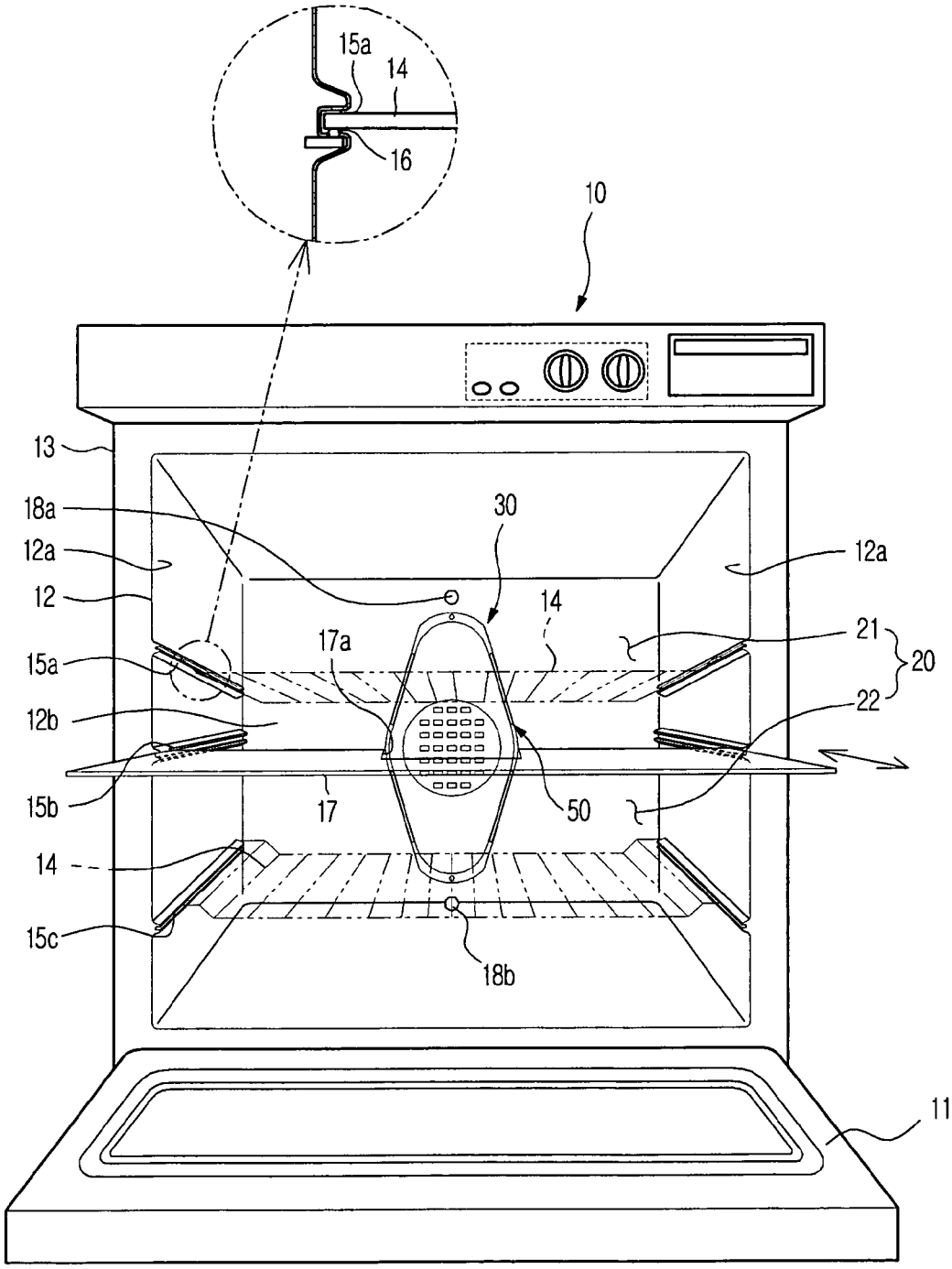
FIG. 1 is a perspective view illustrating the schematic configuration of a cooking apparatus according to an exemplary embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

FIG. 1 is a perspective view illustrating the schematic configuration of a cooking apparatus according to an exemplary embodiment of the present invention.

The cooking apparatus according to the present invention, as shown in FIG. 1, includes a body 10 having an open front surface and defining a cooking chamber 20 therein, a door 11 pivotally rotatably provided at the front surface of the body 10 to open or close the cooking chamber 20, a hot-air feeder 30 to feed hot air into the cooking chamber 20, and an air-direction regulator 50 to regulate the direction of the hot air fed from the hot-air feeder 30.

The body 10 includes an inner case 12 defining the cooking chamber 20 and thermally insulated to reduce the loss of heat to the outside, and an outer case 13 defining the outer appearance.

The inner case 12 defines the cooking chamber 20 to be opened or closed by the door 11 pivotally rotatably provided at the front surface of the body 10. The inner case 12 is provided, at opposite inner surfaces 12*a* thereof, with a plurality of guides 15*a*, 15*b*, and 15*c* to guide the attachment or detachment of a tray 14 on which an object to be cooked, etc. can be put. In the embodiment of the present invention, three pairs of guides are provided.

A weight sensor 16 is located underneath each of the guides 15*a*, 15*b*, and 15*c*, and is used to generate an output signal corresponding to the weight of the object put on the tray 14. The weight sensor 16 is penetrated through the inner case 12. One example of the weight sensor 16 includes a pressure sensor to generate a voltage signal under the influence of a pressure corresponding to the weight of the object put on the tray 14.

At least three weight sensors 16 are provided, respectively, underneath the pairs of guides 15*a*, 15*b*, and 15*c* formed at upper, middle, and lower positions of both the side surfaces 12*a* of the inner case 12. By calculating the center of gravity based on the weight sensed by the respective weight sensors 16, the position of the object to be cooked can be accurately sensed.

As one example of a method for sensing the position of the object to be cooked, Korean Patent Laid-open Publication No. 10-2006-0079814, which was filed and published by the applicant of the present invention, discloses a cooking control apparatus for use in a microwave-range and a control method for the same, wherein, if a plurality of sensor values depending on the weight of an object to be cooked are detected, the position of the object can be sensed by comparing the plurality of detected sensor values. Since the embodiment of the present invention can sense the position of the object to be cooked using a method approximately the same or similar to the disclosed method of the above publication, a detailed description thereof will be omitted and replaced by the contents disclosed in the above publication.

A divider 17 to divide the cooking chamber 20 into a plurality of cooking spaces is detachably installed in the cooking chamber 20. Of the plurality of guides 15*a*, 15*b*, and 15*c*, the center guides 15*b* are usable not only to guide the attachment or detachment of the tray 14, but also to guide the sliding attachment or detachment of the divider 17 that divides the cooking chamber 20 into upper and lower cooking spaces.

Accordingly, once the divider 17 is inserted onto the center guides 15*b* and mounted in the cooking chamber 20, the cooking chamber 20 is divided into an upper first cooking chamber 21 and a lower second cooking chamber 22.

The divider 17 has an approximately rectangular shape. To reduce the circulation of air between the first and second cooking chamber 20 when the divider 17 is mounted in the cooking chamber 20, the divider 17 has an insertion hole 17*a* at a position corresponding to the air-direction regulator 50 protruding to enclose the hot-air feeder 30. The divider 17 contains a heat-insulating material to prevent the transfer of heat between the first and second cooking chambers 21 and 22.

Temperature sensors 18*a* and 18*b* are provided at a rear surface 12*b* of the inner case 12, to measure the temperature of the cooking chamber 20. The temperature sensors 18*a* and 18*b* include a first temperature sensor 18*a* and a second temperature sensor 18*b*. The first temperature sensor 18*a* is provided at an upper position of the rear surface 12*b* of the inner case 12 to measure the temperature of the first cooking chamber 21 when the divider 17 is mounted. Also, when the divider 17 is not mounted, the first temperature sensor 18*a* is used to measure the temperature of the single cooking chamber 20. The second temperature sensor 18*b* is provided at a lower position of the rear surface 12*b* of the inner case 12 to measure the temperature of the second cooking chamber 22 when the divider 17 is mounted. Similarly, when the divider 17 is not mounted, the second temperature sensor 18*b* is used to measure the temperature of the single cooking chamber 20.

The hot-air feeder 30 is provided at the center of the rear surface 12*b* of the inner case 12, to feed hot air into the cooking chamber 20.

Figure 2:
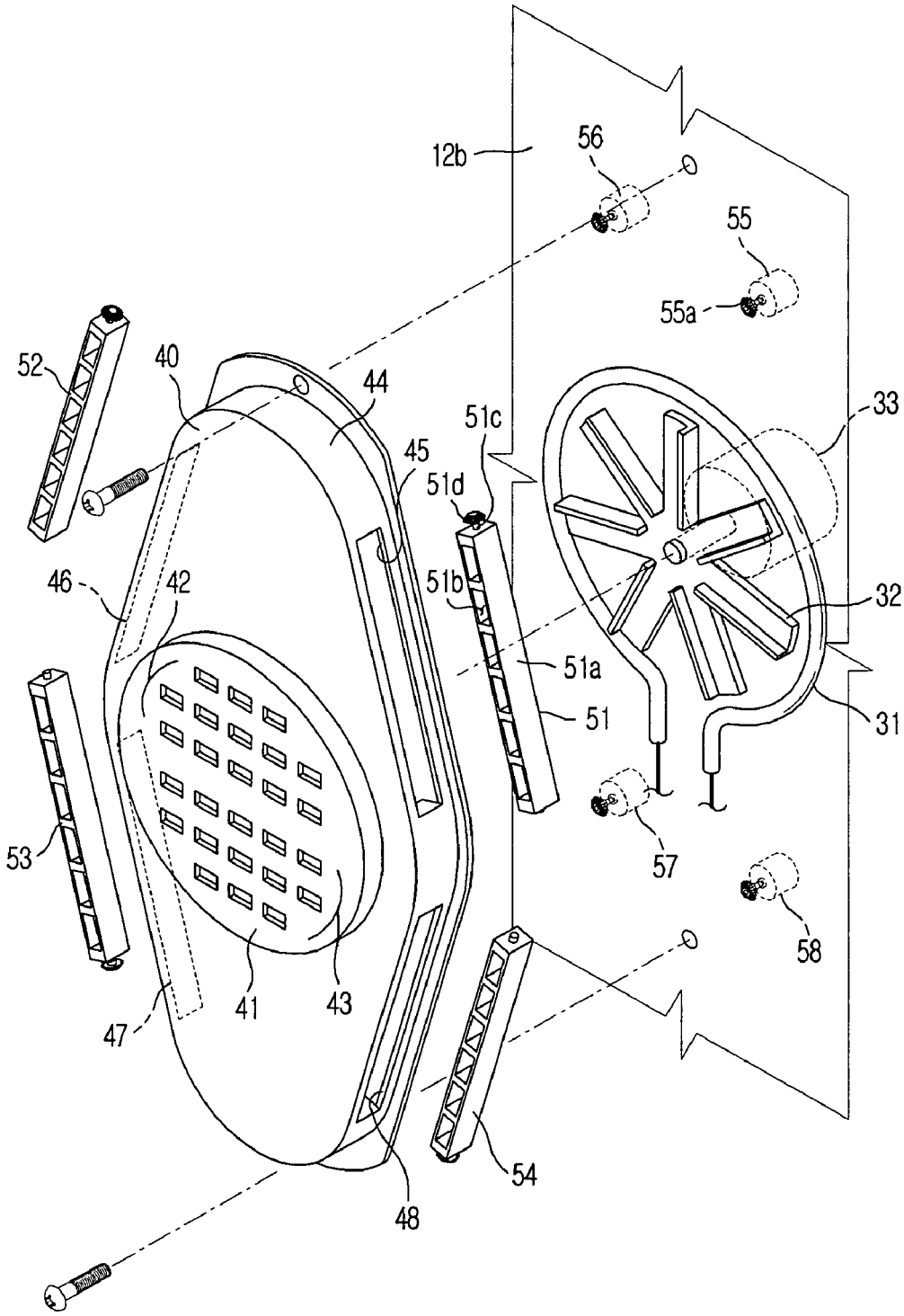
FIG. 2 is an exploded perspective view illustrating a hot-air feeder and an air-direction regulator included in the cooking apparatus according to the present invention.
Figure 3:
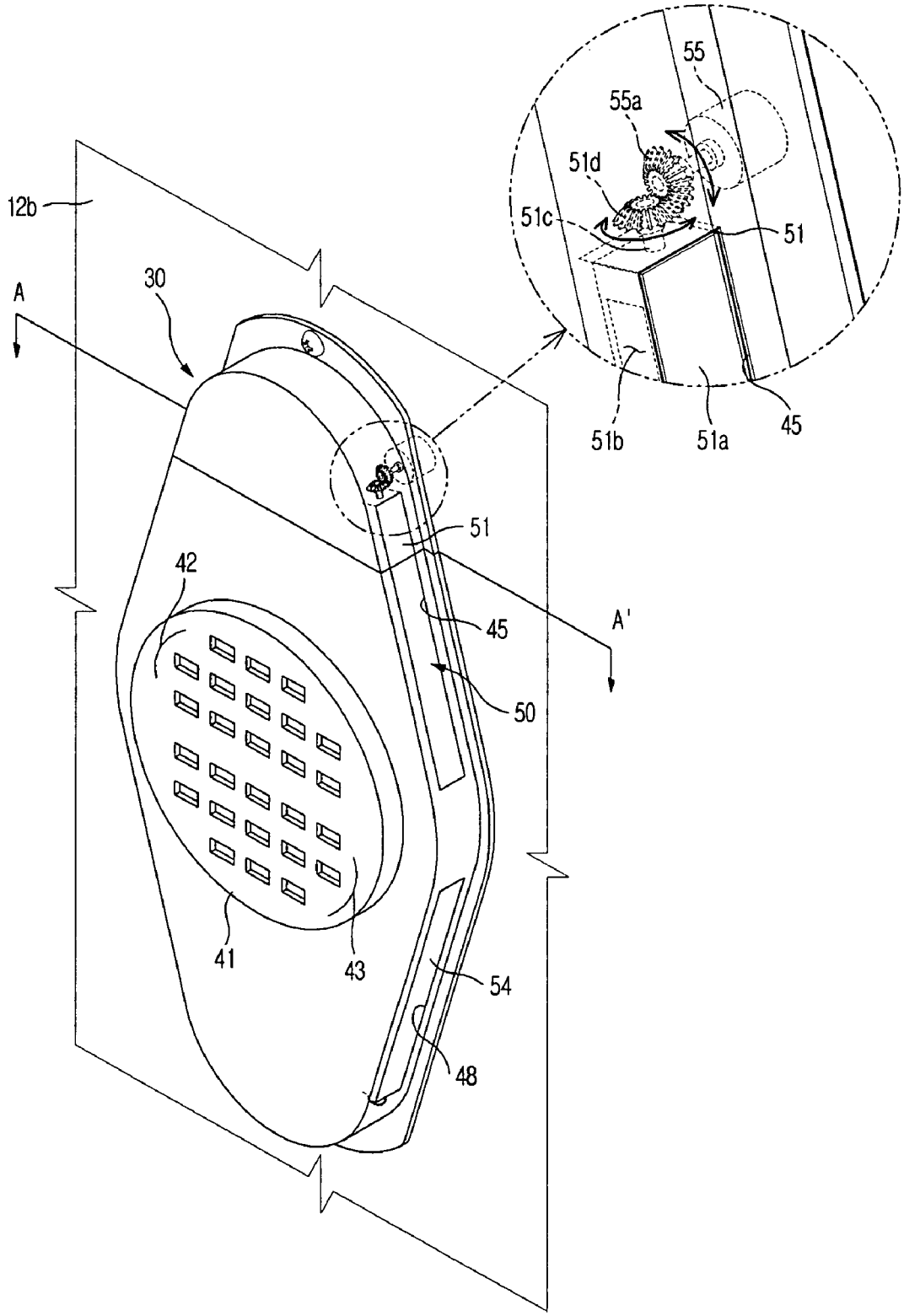
FIG. 3 is a perspective view illustrating a coupled state of the hot-air feeder and the air-direction regulator shown in FIG. 2.
Figure 4:
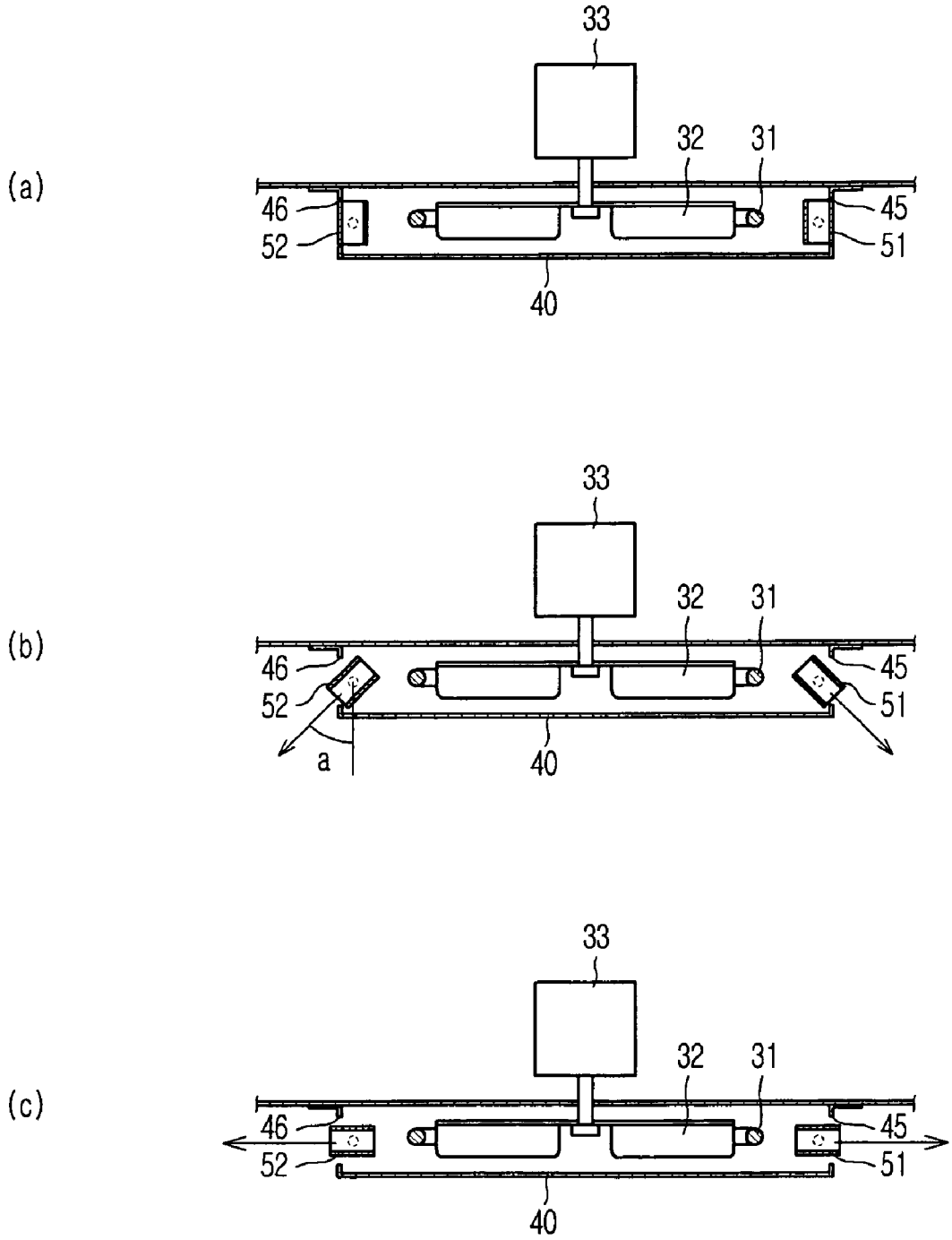
FIG. 4, parts (a)-(c), are process views illustrating the operation of the air-direction regulator included in the cooking apparatus according to the present invention.

FIG. 2 is an exploded perspective view illustrating the hot-air feeder and the air-direction regulator included in the cooking apparatus according to the present invention. FIG. 3 is a perspective view illustrating a coupled state of the hot-air feeder and the air-direction regulator shown in FIG. 2. FIG. 4, parts (a)-(c), are process views illustrating the operation of the air-direction regulator included in the cooking apparatus according to the present invention.

As shown in FIG. 2, the hot-air feeder 30 includes a heater 31, a blowing fan 32 installed inside the heater 31 to forcibly move air heated by the heater 31 into the cooking chamber 20, and a fan cover 40 to cover the blowing fan 32 and having suction holes 42 and 43 and discharge holes 45, 46, 47, and 48.

The heater 31 is provided at the center of a rear surface of the cooking chamber 20 and is used to heat air introduced into the fan cover 40 by operation of the blowing fan 32. Although the heater 31 of the present embodiment has an annular shape, the present invention is not limited to the annular shape, and the heater 31 may have any one of other various shapes.

The blowing fan 32 is used to forcibly circulate the air inside the cooking chamber 20 so as to feed hot air to the object to be cooked, etc. received in the cooking chamber 20 with high heat-transfer efficiency. Although the blowing fan 32 of the present invention is a centrifugal fan, the present invention is not limited thereto, and the blowing fan 32 may be an axial flow fan. The blowing fan 32 may be operated simultaneously with operation of the heater 31, or may be operated independently even when the heater 31 is not operated, if necessary. A fan motor 33 is provided at the rear side of the blowing fan 31, to operate the blowing fan 31.

The fan cover 40 is provided in front of the blowing fan 32 and the heater 31, to cover the blowing fan 32 and the heater 31.

The fan cover 40 has an approximately elliptical shape having a longer vertical length than a horizontal length. The fan cover 40 protrudes forward from the rear surface of the cooking chamber 20, and has the suction holes 42 and 43 and the discharge holes 45, 46, 47, and 48 to suction or discharge the air forcibly blown by the blowing fan 32. Note that the fan cover 40 may have any one of various shapes including a circular or polygonal shape, etc. suitable to cover the blowing fan 32 and the heater 31.

The plurality of suction holes 42 and 43 are perforated in a front center portion 41 of the fan cover 40 corresponding to the front side of the blowing fan 32, to suction the air inside the cooking chamber 20. The suction holes include upper suction holes 42 located above the center of the fan cover 40 and lower suction holes 43 located below the center of the fan cover 40. When the divider 17 is mounted, the upper suction holes 42 are included in the first cooking chamber 21, and the lower suction holes 43 are included in the second cooking chamber 22.

The plurality of discharge holes 45, 46, 47, and 48 are perforated along a peripheral rim portion 44 of the fan cover 40 corresponding to the periphery of the blowing fan 32, to discharge the air heated by the heater 31 into the cooking chamber 20. The plurality of discharge holes 45, 46, 47, and 48 include a first discharge hole 45, a second discharge hole 46, a third discharge hole 47, and a fourth discharge hole 48. On the basis of the center of the fan cover 40, the first discharge hole 45 is located at an upper right position, the second discharge hole 46 is located at an upper left position, the third discharge hole 47 is located at a lower left position, and the fourth discharge hole 48 is located at a lower right position.

When the divider 17 is mounted, the first and second discharge holes 45 and 46 are included in the first cooking chamber 21, and the third and fourth discharge holes 47 and 48 are included in the second cooking chamber 22.

The cooking apparatus according to the present invention includes the air-direction regulator 50 to close the discharge holes 45, 46, 47, and 48 of the fan cover 40, or to change the direction of hot air to be fed from the hot-air feeder 30 into the cooking chamber 20.

The air-direction regulator 50 includes air-direction regulating members 51, 52, 53, and 54 pivotally rotatably coupled to the discharge holes 45, 46, 47, and 48, respectively, so as to open or close the respective discharge holes 45, 46, 47, and 48 and also, to regulate the direction of air to be discharged from the discharge holes 45, 46, 47, and 48. The air-direction regulator 50 further includes drive units to provide the respective air-direction regulating members 51, 52, 53, and 54 with a rotating force (although the present invention uses a drive motor as one example of the drive unit, it will be appreciated that other structures to provide a drive force can be used).

Specifically, the plurality of air-direction regulating members 51, 52, 53, and 54 and the plurality of drive units are provided, respectively, at the plurality of discharge holes 45, 46, 47, and 48. Here, the plurality of air-direction regulating members 51, 52, 53, and 54 include first to fourth air-direction regulating members 51, 52, 53, and 54 provided at the first to fourth discharge holes 45, 46, 47, and 48, respectively.

Since the plurality of air-direction regulating members 51, 52, 53, and 54 have the same configuration as one another and also, the corresponding drive units have the same configuration as one another, hereinafter, only the first air-direction regulating member 51 and the first drive unit will be described, and a description of the remaining air-direction regulating members and drive units will be replaced by the description of first air-direction regulating member 51 and the first drive unit.

The first air-direction regulating member 51 includes a pair of opening/closing portions 51*a* having a width and length corresponding to the first discharge hole 45 so as to close the first discharge hole 45, and a variable discharge portion 51*b* provided between the pair of opening/closing portions 51*a* to communicate the inside and the outside of the fan cover 40 with each other.

Provided at both ends of the first air-direction regulating member 51 are rotating shafts 51*c* to rotatably couple the first air-direction regulating member 51 to the first discharge hole 45.

The first drive unit includes a first drive motor 55 to generate a drive force, a first gear 51*d* provided at one of the rotating shafts 51*c* of the first air-direction regulating member 51, and a second gear 55*a* provided at a rotating shaft of the first drive motor 55.

The first drive motor 55, as shown in FIGS. 2 and 3, is located at a peripheral position of the rear surface 12*b* of the inner case 12, to pivotally rotate the first air-direction regulating member 51.

The second gear 55*a* is engaged with the first gear 51*d* of the first air-direction regulating member 51, to pivotally rotate the first air-direction regulating member 51 installed at the first discharge hole 45 independently.

Accordingly, the first air-direction regulating member 51 is pivotally rotated by a predetermined angle according to a rotation of the second gear 55*a*.

With this configuration, as shown in FIGS. 3 and 4, parts (a)-(c), as the drive motors 55, 56, 57, and 58 are rotated, the air-direction regulating members 51, 52, 53, and 54 are rotated such that their opening/closing portions 51*a* close the discharge holes 45, 46, 47, and 48 of the fan cover 40, so as to prevent hot air from being fed into the cooking chamber 20. Also, according to the rotating angle of the air-direction regulating members 51, 52, 53, and 54, the direction of hot air to be fed from the hot-air feeder 30 into the cooking chamber 20 can be changed by the variable discharge portions 51*b*.

Although the air-direction regulator 50 according to the embodiment of the present invention includes the plurality of drive motors 55, 56, 57, and 58 corresponding to the plurality of air-direction regulating members 51, 52, 53, and 54, note that a single drive motor may be connected to the first to fourth air-direction regulating members by use of connectors (not shown) such that the first to fourth air-direction regulating members can be pivotally rotated by the single drive motor, or that two drive motors may be provided such that each drive motor is connected to a pair of the air-direction regulating members to pivotally rotate the first to fourth air-direction regulating members.

The first to fourth drive motors 55, 56, 57, and 58 may be a variable reluctance type stepping motor having a high rotating angle resolution. This type of drive motor can freely realize a swing mode requiring a continuous direction conversion as well as a stepwise direction conversion of the air-direction regulating members 51, 52, 53, and 54. Note that any other power-generating devices can be used so long as it can realize the continuous direction conversion and the stepwise direction conversion of the air-direction regulating members 51, 52, 53, and 54.

Accordingly, if the drive motors 55, 56, 57, and 58 are operated, the second gears 55*a* connected to the rotating shafts of the drive motors 55, 56, 57, and 58 are rotated. Thereby, the air-direction regulating members 51, 52, 53, and 54, which are orthogonally engaged with the second gears 55*a*, are rotated by the drive motors 55, 56, 57, and 58, thereby regulating the direction of air to be discharged through the plurality of discharge holes 45, 46, 47, and 48, or opening or closing the plurality of discharge holes 45, 46, 47, and 48, respectively, according to the rotating angle thereof.

Hereinafter, for the convenience of description, the first and second discharge holes 45 and 46 are referred to as upper discharge holes 45 and 46, and the third and fourth discharge holes 47 and 48 are referred to as lower discharge holes 47 and 48. Also, the configuration including the first and second air-direction regulating members 51 and 52 is referred to as an upper air-direction regulator, and the configuration including the third and fourth air-direction regulating members 53 and 54 is referred to as a lower air-direction regulator.

Figure 5:
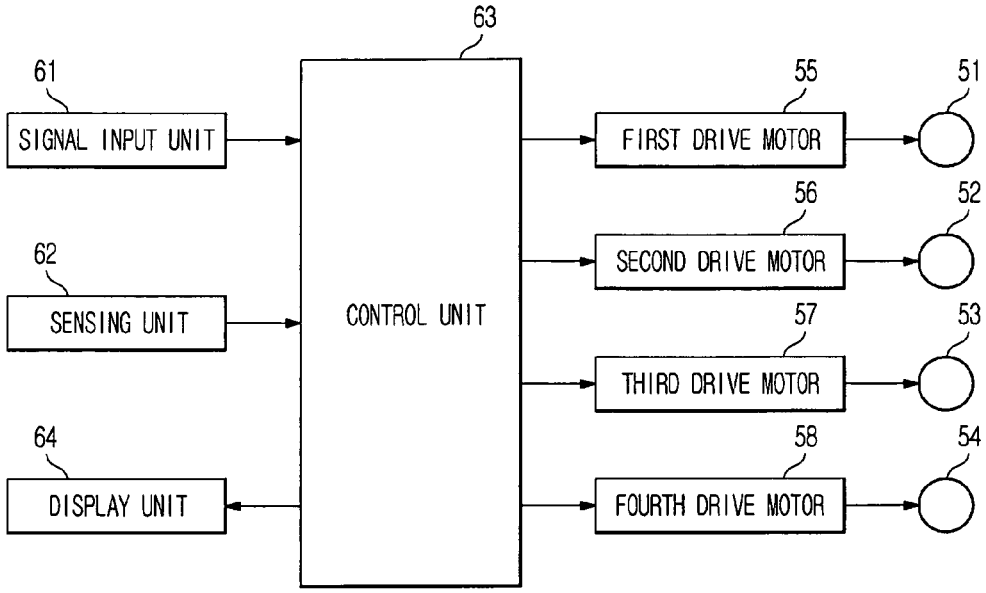
FIG. 5 is a control block diagram of the cooking apparatus according to the present invention.

FIG. 5 is a control block diagram of the cooking apparatus according to the present invention. In addition to the constituent elements shown in FIGS. 1 and 2, the cooking apparatus further includes a signal input unit 61, a sensing unit 62, a control unit 63, and a display unit 64.

The signal input unit 61 inputs cooking information including the kind of an object to be cooked, cooking time, cooking temperature, etc. selected by a user. The sensing unit 62 senses the position of the object put on the tray 14 by use of the weight sensors 16.

The control unit 63 is a microcomputer to control the air-direction regulator 50 according to the kind and position of the object to be cooked. The control unit 63 controls the air-direction regulator 50 according to control signals inputted from the signal input unit 61 and the sensing unit 62, to close the discharge holes 45, 46, 47, and 48, or to adjust the direction of air to be discharged through the discharge holes 45, 46, 47, and 48.

When it is necessary, according to the kind of an object to be cooked, to concentrate hot air onto the object, the control unit 63 senses the position of the object and rotates the air-direction regulating members 51, 52, 53, and 54 based on the sensed results such that the variable discharge portions 51*b* face the object to feed hot air onto the object directly. This is called a concentrative discharge mode.

Also, when it is necessary, according to the kind of an object to be cooked, to uniformly disperse hot air in the cooking chamber 20 (i.e. when it is necessary to achieve a uniform temperature distribution of the cooking chamber), the control unit 63 controls the air-direction regulating members 51, 52, 53, and 54 such that the air-direction regulating members 51, 52, 53, and 54 are pivotally rotated in a direction or are swung by a predetermined angle so as to disperse the hot air in the cooking chamber 20 over a wide range other than being moved in a direction. This is called a dispersive discharge mode.

Here, the control unit 63 can control the plurality of air-direction regulating members 51, 52, 53, and 54 independently. Therefore, by differentiating the pivotal rotating direction or swing angle of the respective air-direction regulating members 51, 52, 53, and 54, turbulent flow is caused in the cooking chamber 20, thereby achieving a more uniform temperature distribution in the cooking chamber 20.

For example, the first and third air-direction regulating members 51 and 53 can be rotated forward and simultaneously, the second and fourth air-direction regulating members 52 and 54 can be rotated reversely. Alternatively, the first and third air-direction regulating members 51 and 53 can be swung by a rotating angle $\alpha$ of 20~70 degrees, and the second and fourth air-direction regulating members 52 and 54 can be swung by an angle of 40~90 degrees (See FIG. 4, part (b)). As described above, various combinations of the pivotal rotations of the first to fourth air-direction regulating members 51, 52, 53, and 54 can be expected. The pivotal rotating direction, angle, etc. of the air-direction regulating members suitable to achieve the uniform temperature distribution of the cooking chamber 20 can be experimentally derived and previously recorded in a ROM table in the control unit 63.

As described in the embodiment of the present invention, the concentrative discharge mode and the dispersive discharge mode can be selected automatically by storing a discharge mode (i.e. a concentrative discharge mode, dispersive discharge mode, etc.) corresponding to the kind of an object selected by a user in the ROM table of the control unit 63, and comparing the kind of the object selected by the user with data previously stored in the control unit 63. Note that the user can directly select the concentrative discharge mode or the dispersive discharge mode by use of the signal input unit 61.

In the case where the divider 17 is mounted in the cooking chamber 20 to divide the cooking chamber 20 into the first and second cooking chambers 21 and 22, if a cooking temperature of any one of the cooking chambers 21 and 22 is not set (i.e. only one of the first and second cooking chambers 21 and 22 is used), the control unit 63 controls the upper air-direction regulating members 51 and 52 or the lower air-direction regulating members 53 and 54 to close the discharge holes provided in the corresponding cooking chamber, in order to prevent hot air from being fed into the corresponding cooking chamber. In this case, the remaining cooking chamber is controlled to perform the concentrative discharge mode or the dispersive discharge mode by operation of the upper air-direction regulating members 51 and 52 or the lower air-direction regulating members 53 and 54.

Also, in the case where the divider 17 is mounted and the first and second cooking chambers 20 are used to cook objects (i.e. both the first and second cooking chambers are used), if it is necessary, according to the kind of objects, to concentrate hot air onto the objects, as described above, the control unit 63 senses the positions of the objects and rotates the air-direction regulating members 51, 52, 53, and 54 based on the sensed results such that the variable discharge portions 51*b* face the objects, in order to feed hot air onto the objects directly. Also, if it is necessary, according to the kind of objects, to uniformly disperse hot air in the cooking chamber 20 (i.e. it is necessary to achieve a uniform temperature distribution in the cooking chamber), the air-direction regulating members 51, 52, 53, and 54 are pivotally rotated in a predetermined direction or are swung by a predetermined angle, so as to cause turbulent flows in the cooking chamber 20.

Accordingly, in the case where the divider 17 is mounted in the cooking chamber 20 and any one of the cooking chambers 21 and 22 is used, the control unit 63 closes the discharge holes associated with the unused cooking chamber and can perform the concentrative discharge mode or the dispersive discharge mode with respect to the used cooking chamber. Also, in the case where both the first and second cooking chambers 21 and 22 are used, the air-direction regulator 50 can be controlled such that both the first and second cooking chambers 21 and 22 perform the concentrative discharge mode or the dispersive discharge mode. Alternatively, the air-direction regulator 50 can be controlled such that any one of the first and second cooking chambers performs the concentrative discharge mode and the other cooking chamber performs the dispersive discharge mode.

The display unit 64 is used to display an operating state, error mode, etc. of the cooking apparatus based on a display control signal from the control unit 63. The display unit 64 visually displays movements of the air-direction regulating members 51, 52, 53, and 54 performing the concentrative discharge mode or the dispersive discharge mode, thereby allowing the user to know the direction of the air-direction regulating members 51, 52, 53, and 54.

Hereinafter, the operation and effects of the cooking apparatus having the above described configuration will be described.

First, the case where no divider is mounted in the cooking chamber 20 to allow the overall cooking chamber 20 to be used as a single cooking space will be described.

Figure 6:
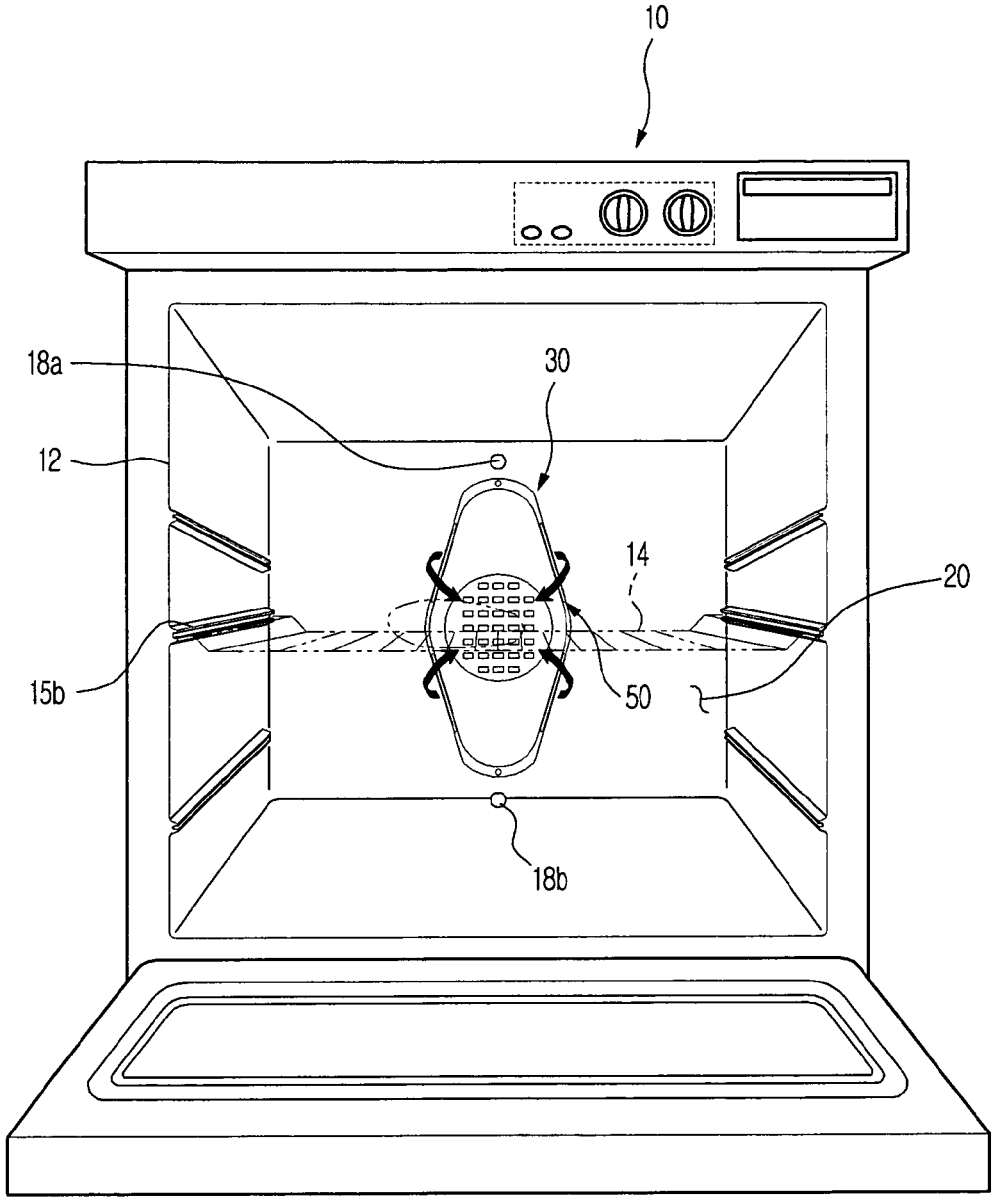
FIGS. 6 and 7 are views illustrating the circulation of air in a cooking chamber when the cooking chamber is used as a single cooking space to perform a concentrative discharge mode.
Figure 7:
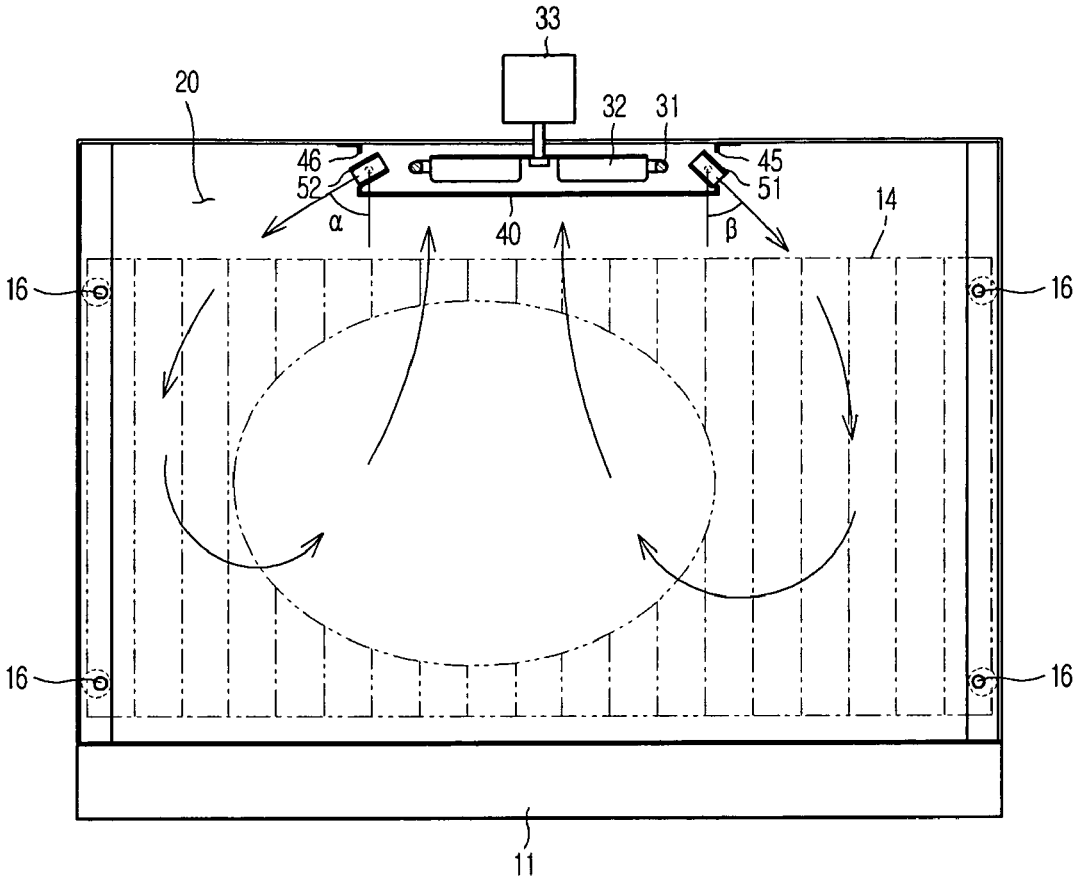
Figure 8A:
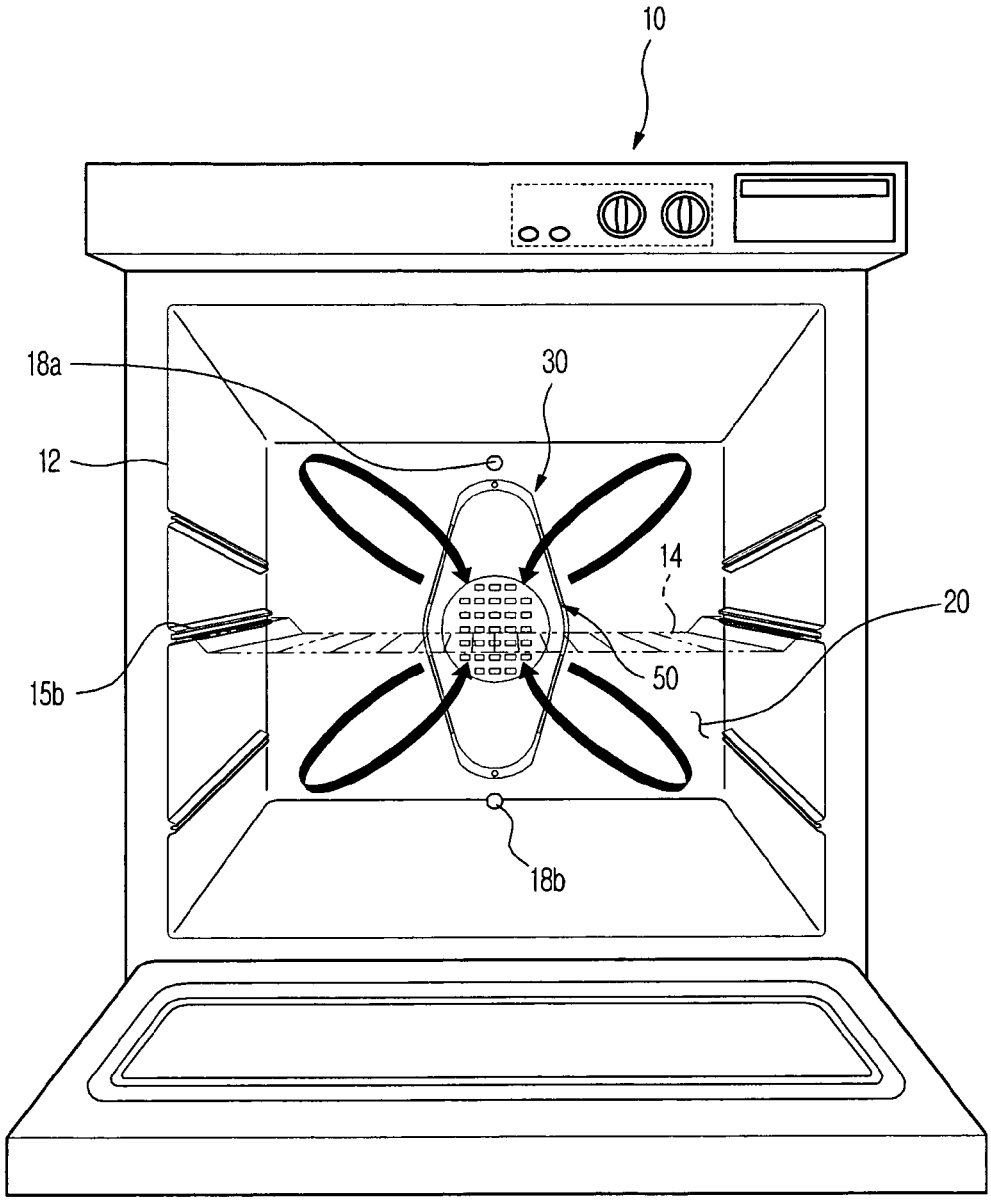
FIG. 8A is a view illustrating the circulation of air in a cooking chamber when the cooking chamber is used as a single cooking space to perform a fixed dispersive discharge mode.
Figure 8B:
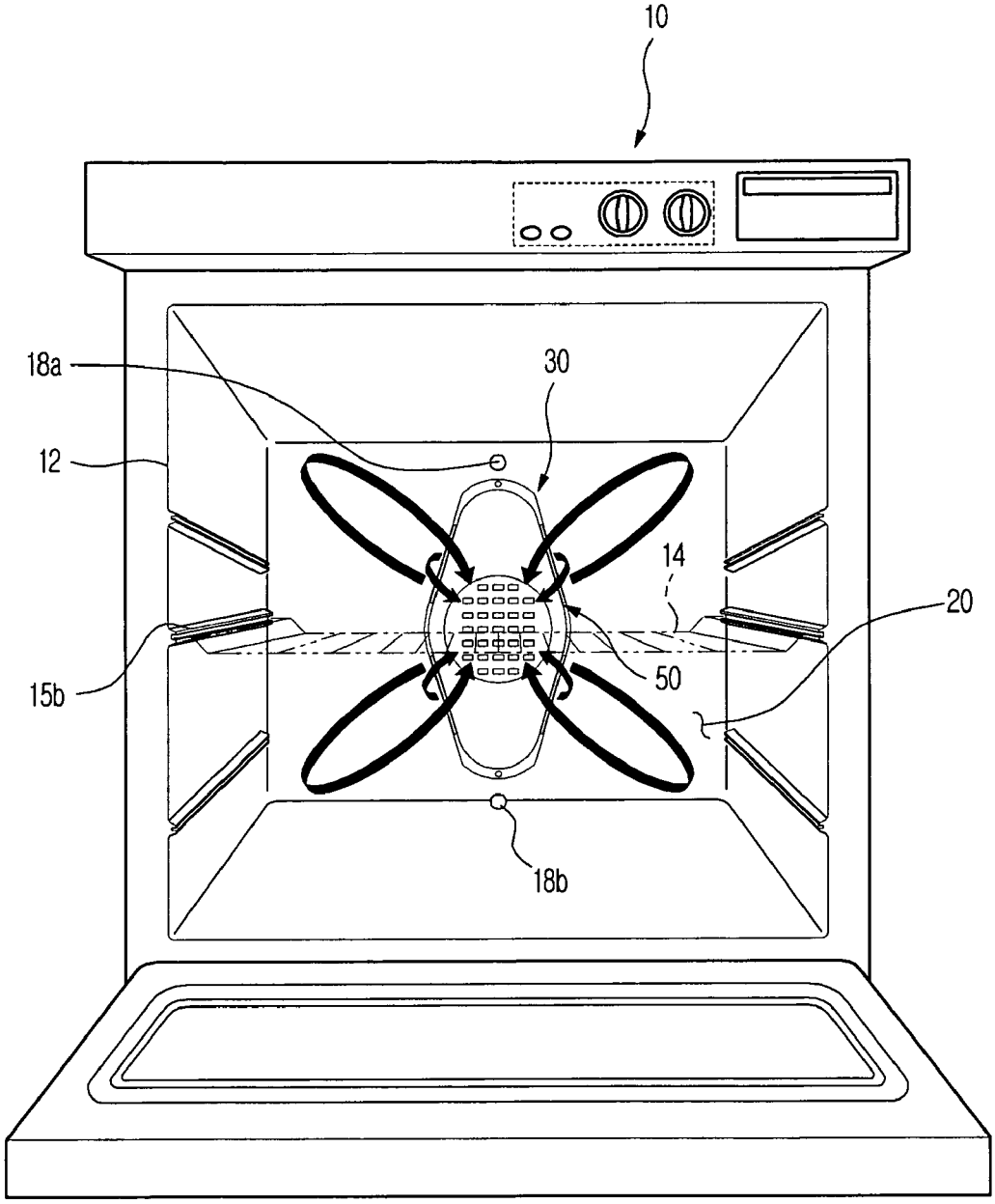
FIG. 8B is a view illustrating the circulation of air in a cooking chamber when the cooking chamber is used as a single cooking space to perform a variable dispersive discharge mode.

FIGS. 6 and 7 are views illustrating the circulation of air in the cooking chamber when the cooking chamber is used as a single cooking space to perform the concentrative discharge mode. FIGS. 8A and 8B are views illustrating the circulation of air in the cooking chamber when the cooking chamber is used as a single cooking space to perform the dispersive discharge mode.

In an initial state of the operation of the cooking apparatus according to the embodiment of the present invention, the discharge holes 45, 46, 47, and 48 of the fan cover 40, as shown in FIG. 4, part (a), are kept in a completely closed state by the opening/closing portions 51*a* of the air-direction regulating members 51, 52, 53, and 54. In this case, note that the discharge holes 45, 46, 47, and 48 can be set to various initial states such that the air-direction regulating members have an angle with respect to the discharge holes, other than being initially kept in a closed state.

If the user inputs cooking information such as the kind of an object to be cooked, cooking time, cooking temperature, etc. by use of the signal input unit 61 to begin a cooking operation, the heater 31 and the blowing fan 32 are operated, such that the air inside the cooking chamber 20 is introduced into the fan cover 40 through the suction holes 42 and 43. Then, after being heated by the heater 31, the air is moved toward the discharge holes 45, 46, 47, and 48.

In this case, the control unit 63 compares the kind of the object selected by the user with data previously stored in the ROM table, to determine whether the concentrative discharge mode or the dispersive discharge mode is performed.

If it is determined, based on the kind of the object to be cooked, that the concentrative discharge mode is performed, the sensing unit 62 senses the position of the object put on the tray 14 by use of the weight sensors 16, thereby allowing the air-direction regulating members 51, 52, 53, and 54 to be pivotally rotated to discharge hot air onto the sensed position of the food. In this case, as shown in FIG. 7, if the object is located at a position deflected from the center of the cooking chamber 20, the first air-direction regulating member 51 is pivotally rotated counterclockwise by an angle $\beta$, and the second air-direction regulating member 52 is pivotally rotated clockwise by an angle $\alpha$, so as to feed hot air toward the object. Simultaneously, the third and fourth air-direction regulating members 53 and 54 are appropriately pivotally rotated to concentrate hot air onto the object. In this case, experimental data related to the pivotal rotations of the air-direction regulating members 51, 52, 53, and 54 are previously stored in the ROM table of the control unit 63, to concentrate the hot air onto the object based on the position of the object. In this way, the air-direction regulating members 51, 52, 53 and 54 can be pivotally rotated, to ensure the optimum feeding of hot air based on the position of the object to be cooked.

Also, if it is determined that the dispersive discharge mode is performed, the air-direction regulating members 51, 52, 53, and 54 are opened to the maximum extent as shown in FIG. 4, part (c), to feed hot air into the overall cooking chamber. For this, the angle of the air-direction regulating members 51, 52, 53, and 54 can be fixed at 90 degrees to perform a fixed dispersive discharge mode as shown in FIG. 8A. Also, to achieve a more uniform temperature distribution in the cooking chamber 20, as shown in FIG. 8B, the air-direction regulating members 51, 52, 53, and 54 can be swung by a predetermined period to perform a variable dispersive discharge mode, so as to cause turbulent flows in the cooking chamber 20. Although the case where the air-direction regulating members 51, 52, 53, and 54 provided at the respective discharge holes 45, 46, 47, and 48 are operated simultaneously by the same angle is described, note that the air-direction regulating members 51, 52, 53, and 54 can be operated by different angles from one another to further cause turbulent flows. Hereinafter, the variable dispersive discharge mode will be described as a basic implementation aspect.

The temperature of the cooking chamber 20 is sensed by use of the first or second temperature sensor 18*a* or 18*b* while an object is cooked in the cooking chamber 20 in the concentrative discharge mode or dispersive discharge mode. If the sensed temperature exceeds a preset cooking temperature or previously stored cooking temperature depending on the kind of object, the heater 31 or the blowing fan 32 is turned off, or the air-direction regulating members 51, 52, 53, and 54 are pivotally rotated such that the opening/closing portions 51*a* close the discharge holes 45, 46, 47, and 48. As this closing operation is repeatedly performed, the temperature of the cooking chamber 20 can be kept at the preset cooking temperature.

If the above described cooking operation of the object is performed beyond a preset cooking time or previously stored cooking time depending on the kind of object, the heater 31 and the blowing fan 32 are turned off, to complete the cooking operation.

Accordingly, by changing the direction of hot air to be fed into the cooking chamber 20 by use of the air-direction regulating members 51, 52, 53, and 54, the hot air may be concentrated to the object or may be uniformly distributed in the overall cooking chamber 20, if necessary. As a result, the cooking apparatus can perform a cooking operation suitable for different respective objects to be cooked, thereby achieving an improved cooking performance.

Next, the case where the divider 17 is mounted to divide the cooking chamber 20 into the first and the second chambers 21 and 22 will be described.

Figure 9:
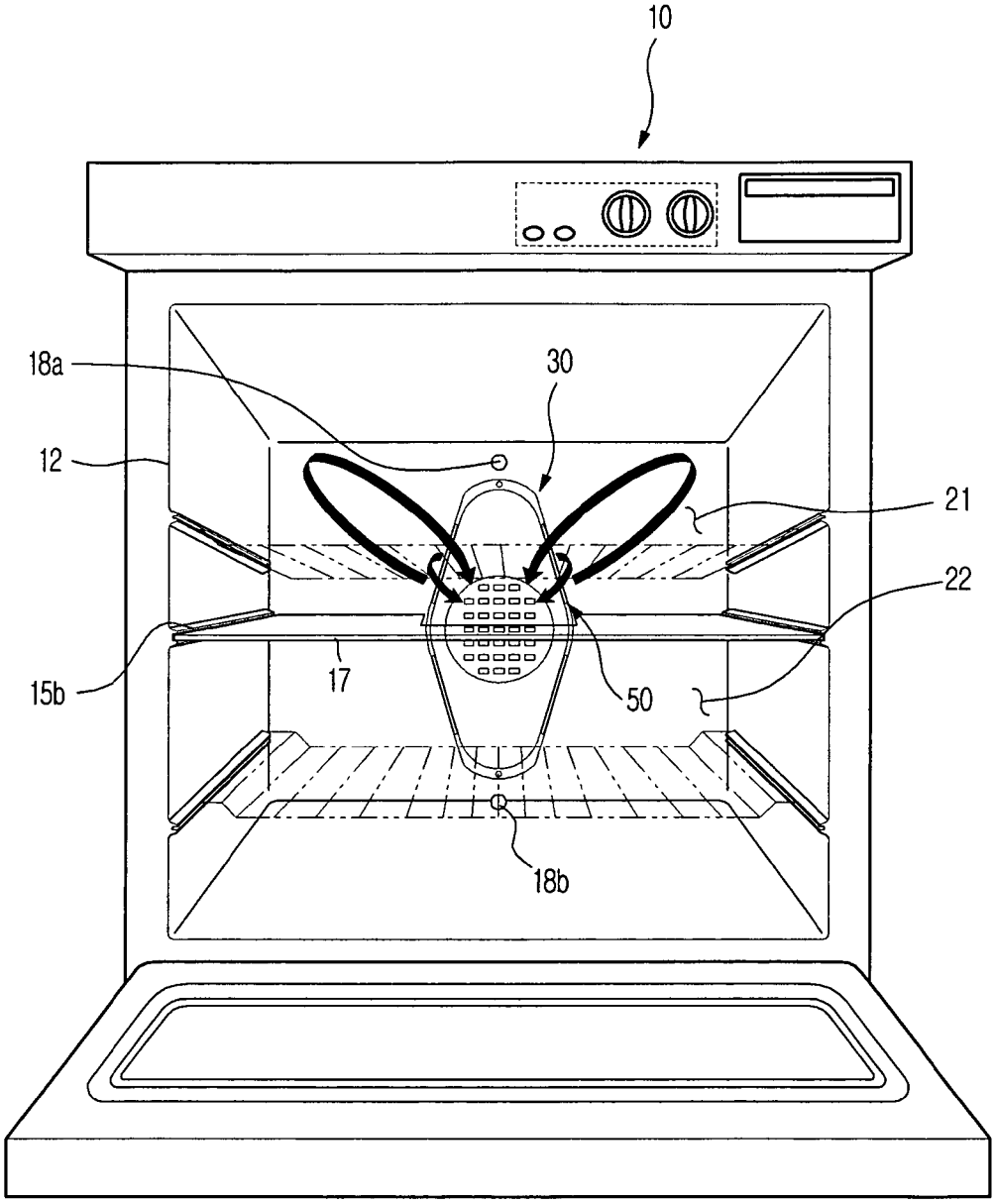
FIG. 9 is a view illustrating the circulation of air in a first cooking chamber, which is partitioned by a divider installed in the cooking chamber and performs a variable dispersive discharge mode.
Figure 10:
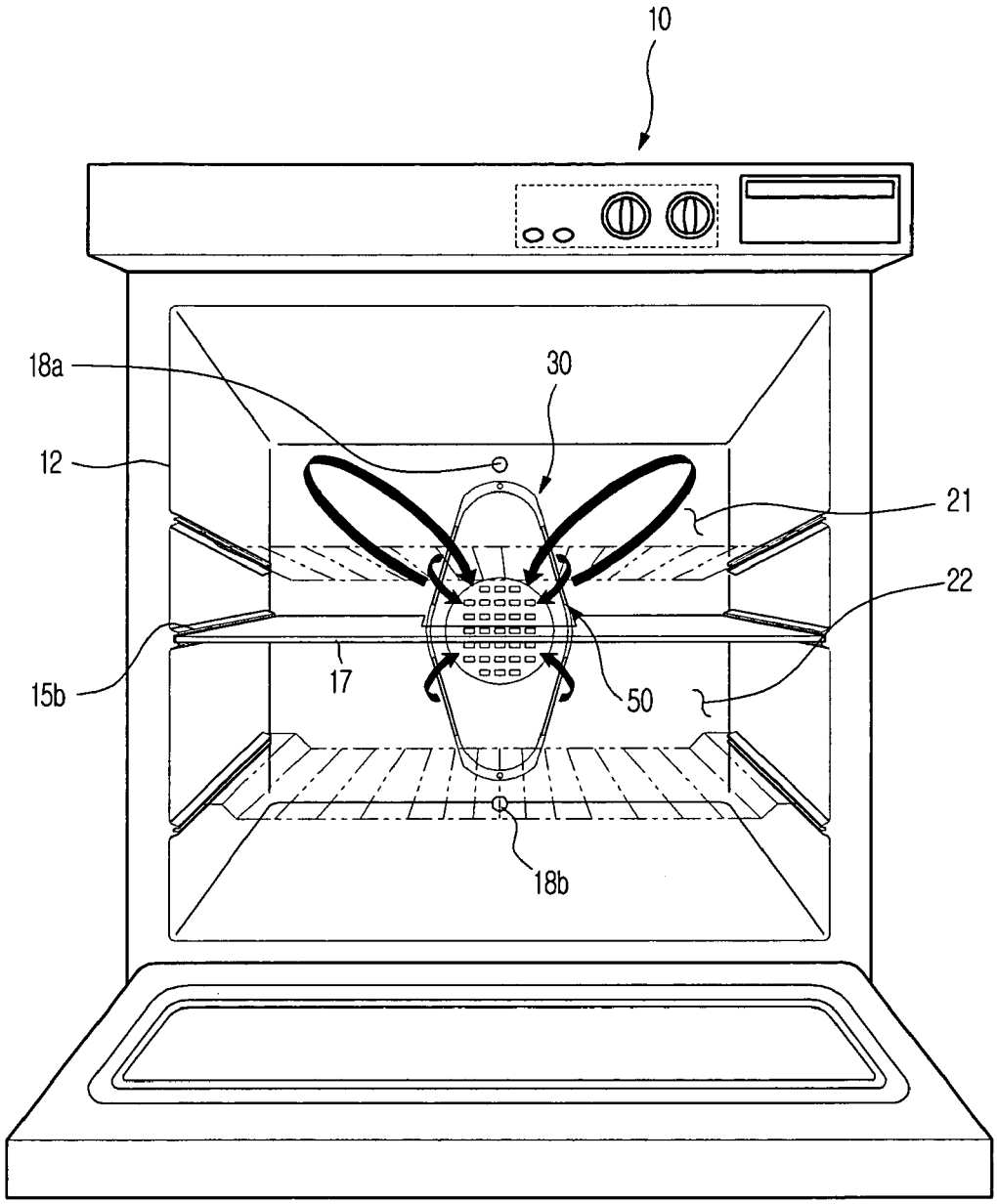
FIG. 10 is a view illustrating the circulation of air when first and second cooking chambers separated from each other by a divider of the cooking chamber perform different discharge modes from each other.

FIG. 9 is a view illustrating the circulation of air in the first cooking chamber, which is partitioned by the divider 17 and performs the variable dispersive discharge mode. FIG. 10 is a view illustrating the circulation of air when the first and second cooking chambers 21 and 22 are separated from each other by the divider 17 and perform different discharge modes from each other.

If the user inputs cooking information such as the kind of an object to be cooked, cooking time, cooking temperature, etc. with respect to the first cooking chamber 21 by use of the signal input unit 61 without inputting cooking information with respect to the second cooking chamber 22 (i.e. only the first cooking chamber is operated) to begin a cooking operation, the heater 31 and the blowing fan 32 are operated such that the air inside the cooking chamber 20 is introduced into the fan cover 40 through the suction holes 42 and 43. Then, after being heated by the heater 31, the air is moved toward the discharge holes 45, 46, 47, and 48.

Since the second cooking chamber 22 does not perform a cooking operation, the lower air-direction regulating members 53 and 54 are kept to close the lower discharge holes 47 and 48.

As the first cooking chamber 21 performs a cooking operation, the control unit 63 compares the kind of the object selected by the user with data previously stored in the ROM table, to determine whether the concentrative discharge mode or the dispersive discharge mode is performed.

If it is determined, based on the kind of the object to be cooked, that the concentrative discharge mode is performed, the sensing unit 62 senses the position of the object put on the tray 14 by use of the weight sensors 16. Although not shown in the drawings, the upper air-direction regulating members 51 and 52 are pivotally rotated to discharge hot air to the sensed position of the object, in the same manner as the above described concentrative discharge mode when no divider is mounted in the cooking chamber.

Also, if it is determined that the dispersive discharge mode is performed, the upper air-direction regulating members 51 and 52 are swung as shown in FIG. 9 to cause turbulent flows in the first cooking chamber 21, thereby achieving a uniform temperature distribution in the first cooking chamber 21.

The temperature of the first cooking chamber 21 is sensed by use of the first temperature sensor 18*a* while food is cooked in the first cooking chamber 21 in the concentrative discharge mode or the dispersive discharge mode. If the sensed temperature exceeds a preset cooking temperature or previously stored cooking temperature depending on the kind of object, the heater 31 or the blowing fan 32 is turned off, or the upper air-direction regulating members 51 and 52 are pivotally rotated to close the upper discharge holes 45 and 46. As this closing operation is repeatedly performed, the temperature of the first cooking chamber 21 can be kept at the preset cooking temperature.

If the above described cooking operation of the object is performed beyond a preset cooking time or previously stored cooking time depending on the kind of object, the heater 31 and the blowing fan 32 are turned off, to complete the cooking operation in the first cooking chamber 21.

On the contrary, in the case where no cooking information with respect to the first cooking chamber 21 is inputted and only cooking information with respect to the second cooking chamber 22 is inputted, note that the second cooking chamber 22 can perform the concentrative discharge mode or the dispersive discharge mode, in the same manner as the operation of the first cooking chamber 21.

Accordingly, when it is desired to cook a small amount of food relative to the volume of a cooking space, it is preferable that the cooking chamber 20 be divided into the first and second cooking chambers 21 and 22 by use of the divider 17 to selectively use any one of the first and second cooking chambers 21 and 22, thereby achieving a reduced cooking time and low consumption of electric power.

Even in this case, by changing the direction of hot air to be fed into the cooking chamber, the hot air can be concentrated onto the food or be uniformly distributed in the overall cooking chamber if necessary, so as to perform a cooking operation suitable for different respective objects to be cooked, and consequently, to provide the cooking apparatus with an improved cooking performance.

Next, in a state wherein the divider 17 is mounted in the cooking chamber 20, if the user inputs cooking information such as the kind of an object to be cooked, cooking time, cooking temperature, etc. with respect to both the first and second cooking chambers 21 and 22 by use of the signal input unit 61 to begin a cooking operation, the heater 31 and the blowing fan 32 are operated such that the air inside the cooking chamber 20 is introduced into the fan cover 40 through the suction holes 42 and 43. Then, after being heated by the heater 31, the air is moved toward the discharge holes 45, 46, 47, and 48.

As both the first and second cooking chambers 21 and 22 perform a cooking operation, the control unit 63 determines whether the concentrative discharge mode or the dispersive discharge mode is performed, in the same manner as the above description.

If it is determined, based on the kind of the object to be cooked in the first cooking chamber 21, that the dispersive discharge mode is performed, as shown in FIG. 10, the upper air-direction regulating members 51 and 52 are swung to cause turbulent flows in the first cooking chamber 21, thereby achieving a uniform temperature distribution in the first cooking chamber 21.

Also, if it is determined, based on the kind of the object to be cooked in the second cooking chamber 22, that the concentrative discharge mode is performed, the position of the object is sensed in the same manner as the above description, and the lower air-direction regulating members 53 and 54 are pivotally rotated to discharge hot air to the sensed position of the object, in the same manner as the implementation of the concentrative discharge mode when no divider is mounted in the cooking chamber 20.

The first cooking chamber 21 performs the dispersive discharge mode, and the second cooking chamber 22 performs the concentrative discharge mode, to cook the objects in the first and second cooking chambers 21 and 22. During the cooking operation, the temperature of the first cooking chamber 21 is sensed by the first temperature sensor 18*a*, and the temperature of the second cooking chamber 22 is sensed by second temperature sensor 18*b*.

In this case, if the sensed temperature exceeds a preset cooking temperature or previously stored cooking temperature depending on the kind of object, the air-direction regulating members provided in the corresponding cooking chamber are pivotally rotated such that their opening/closing portions close the corresponding discharge holes. As this closing operation is repeatedly performed, the temperature of the cooking chamber 20 can be kept at the preset cooking temperature.

If the above described cooking operation of the object in any one of the first and second cooking chambers 21 and 22 is performed beyond a preset cooking time or previously stored cooking time depending on the kind of object, the air-direction regulating members in the corresponding cooking chamber are pivotally rotated to close the discharge holes, so as to complete the cooking operation of the corresponding cooking chamber.

Thereafter, if the cooking operation of the other cooking chamber is performed beyond a preset cooking time, the heater 31 and the blowing fan 32 are turned off, to complete the cooking operation of the other cooking chamber. In this case, the cooking operation can be completed as the air-direction regulating members in the other cooking chamber are pivotally rotated to close the corresponding discharge holes.

Although the above described embodiment describes an operating example in that the first cooking chamber 21 performs the dispersive discharge mode and the second cooking chamber 22 performs the concentrative discharge mode, note that each of the first and second cooking chambers can independently perform the dispersive discharge mode and the concentrative discharge mode.

Accordingly, a plurality of cooking spaces can be heated at different temperatures from each other even by using a single heater and a single blowing fan, and the direction of air to be fed into the respective cooking spaces can be changed to concentrate hot air to an object to be cooked or to uniformly disperse hot air in the overall cooking chamber if necessary. As a result, the cooking apparatus can perform a cooking operation suitable for different respective objects to be cooked, thereby achieving an improved cooking performance.

Hereinafter, air-direction regulating members according to alternative embodiments of the present invention will be described.

Figure 11:
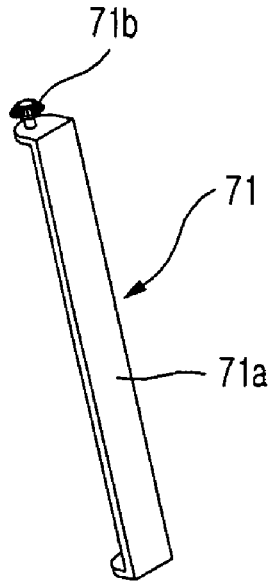
FIG. 11, parts (a) and (b), are perspective views illustrating air-direction regulating members according to alternative embodiments of the present invention.
Figure 11:
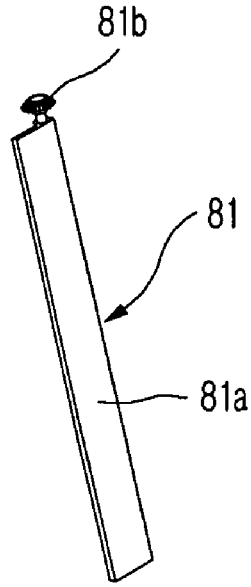
Figure 12:
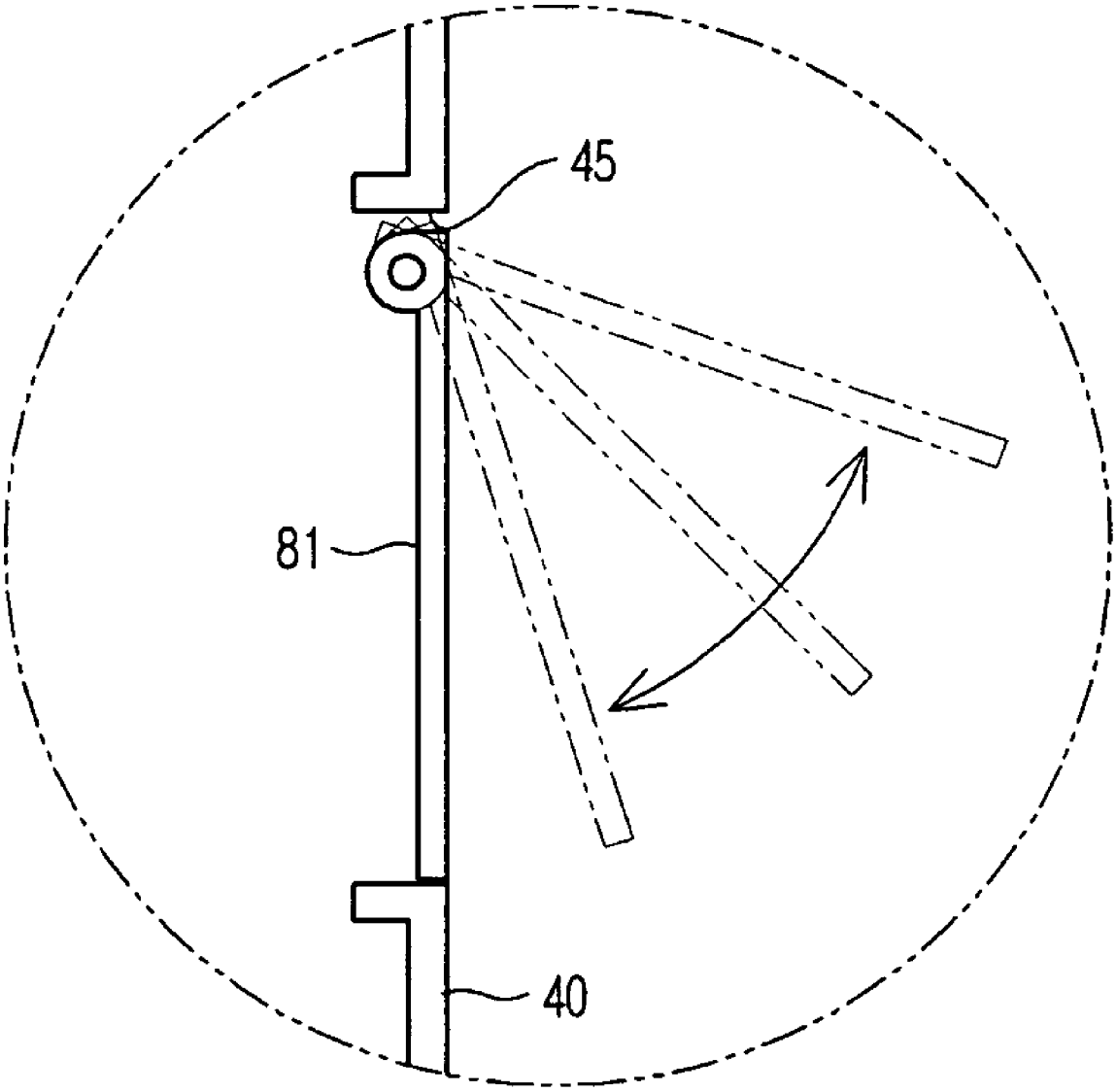
FIG. 12 is a process view illustrating the operation of the air-direction regulating member shown in FIG. 11, part (b).

FIG. 11, parts (a) and (b), are perspective views illustrating air-direction regulating members according to alternative embodiments of the present invention. FIG. 12 is a process view illustrating the operation of the air-direction regulating member shown in FIG. 11, part (b). Since the alternative embodiments of the present invention have approximately the same configurations as the above described embodiment except for the air-direction regulating members, the following description will be limited to the air-direction regulating members of the alternative embodiments, and a description of the other configurations will be omitted.

An air-direction regulating member 71, according to a first alternative embodiment as shown in FIG. 11, part (a), has an opening/closing portion 71*a* having a width and length corresponding to the discharge hole 45, to close the discharge hole 45. Both ends of the opening/closing portion 71*a* are bent to form flanges. Each flange is centrally provided with a gear 71*b* to transmit the rotating force of the drive motor in a direction perpendicular to the rotating direction, so as to allow the air-direction regulating member 71 to rotate at the discharge hole 45.

With the above described configuration, the opening/closing portion 71*a* can close the discharge hole 45, and also, can change the direction of air to be discharged from the discharge hole 45 according to a rotating angle thereof. As compared to the air-direction regulating member of the above described embodiment, the air-direction regulating member 71 can achieve a more simplified configuration.

An air-direction regulating member 81, according to a second alternative embodiment of the present invention as shown in FIG. 11, part (b), has a blade-shaped opening/closing portion 81*a* having a width and length corresponding to the discharge hole 45, to close the discharge hole 45. One end of the opening/closing portion 81*a* is provided with a gear 81*b* to transmit the rotating force of the drive motor in a direction perpendicular to the rotating force, so as to allow the air-direction regulating member 81 to rotate at the discharge hole 45.

With the above described configuration, the air-direction regulating member 81 can close the discharge hole 45 upon receiving the rotating force of the drive motor, and also, can change the flow rate and direction of air to be discharged from the discharge hole 45 according to a rotating angle thereof as shown in FIG. 12. That is, when the opening/closing portion 81 a has a small rotating angle, the air discharged from the discharge hole 45 is moved forward, and has a low flow rate due to a narrow distance between the discharge hole 45 and the opening/closing portion 81*a*. Also, when the opening/closing portion 81*a* has a large rotating angle, the air discharged from the discharge hole 45 is dispersed forward and laterally, and has a high flow rate due to a wide distance between the discharge hole 45 and the opening/closing portion 81*a*. Accordingly, the air-direction regulating members according to the alternative embodiments of the present invention have the effects of regulating the flow rate of air as well as the direction of air, as compared to the air-direction regulating member according to the above described embodiment of the present invention.

As apparent from the above description, the present invention provides a cooking apparatus and a method for controlling the same having the following effects.

Firstly, the cooking apparatus of the present invention includes an air-direction regulator, and has the effect of changing the direction of air to be fed into a cooking chamber.

Secondly, by changing the direction of hot air to be fed into the cooking chamber by means of air-direction regulating members, it is possible to concentrate the hot air to an object to be cooked or to uniformly disperse the hot air in the overall cooking chamber if necessary. As a result, a cooking operation suitable for different kinds of objects to be cooked can be performed, resulting in an improved cooking performance.

Thirdly, a plurality of cooking spaces can be heated at different temperatures from one another even by use of a single heater and a single blowing fan, and the direction of hot air to be fed into each cooking space can be changed.

Fourthly, when it is desired to cook a small amount of food relative to the volume of the cooking chamber, the cooking chamber can be divided into a plurality of cooking spaces, to allow only a selected cooking space to be used. This has the effect of reducing a cooking time and the consumption of electric power.

Fifthly, with the use of a blade-shaped air-direction regulating member, the opening degree of a discharge hole can be controlled. This allows the flow rate and direction of air to be fed into the cooking chamber to be controlled simultaneously.

Although embodiments of the present invention have been shown and described, it would be appreciated by those skilled in the art that changes may be made in this embodiment without departing from the principles and spirit of the invention, the scope of which is defined in the claims and their equivalents. For example, although the case where the hot-air feeder and the air-direction regulator are installed at the rear surface of the cooking chamber is described herein, the technical ideal of the present invention can be realized even by modifications of a fan cover and a divider which are installed at a side surface of the cooking chamber.

What is claimed is:

1. A cooking apparatus comprising:

a cooking chamber;

a hot-air feeder to feed hot air into the cooking chamber;

at least one air-direction regulator to change a direction of the hot air fed from the hot-air feeder, the air-direction regulator having an operating mode comprising a concentrative discharge mode to concentrate the hot air fed from the hot-air feeder to a specific region in the cooking chamber and a dispersive discharge mode to widely disperse the hot air in the cooking chamber; and a sensing unit to sense a position of an object to be cooked in the cooking chamber, wherein, in the concentrative discharge mode, the air-direction regulator concentrates the direction of the hot air to the position of the object sensed by the sensing unit in response to a signal from the sensing unit.

2. The apparatus according to claim 1, wherein the hot-air feeder comprises a fan cover having a discharge hole, and the air-direction regulator comprises an air-direction regulating member provided at the discharge hole and a drive unit to rotatably operate the air-direction regulating member.

3. The apparatus according to claim 2, wherein the air-direction regulating member closes the discharge hole, or is rotated by a predetermined angle under operation of the drive unit so as to regulate a discharge angle of the hot air to be discharged from the discharge hole.

4. The apparatus according to claim 2, wherein the air-direction regulating member comprises a pair of opening/closing portions corresponding to the discharge hole so as to close the discharge hole, and a variable discharge portion provided between the opening/closing portions to communicate the inside and the outside of the fan cover with each other.

5. The apparatus according to claim 2, wherein the air-direction regulating member has a blade shape.

6. The apparatus according to claim 4, wherein the drive unit comprises a drive motor to generate a drive force, a first gear provided at one end of the air-direction regulating member, and a second gear provided at a rotating shaft of the drive motor so as to be engaged with the first gear.

7. The apparatus according to claim 1, further comprising:

an input unit to input a user's command or the kind of an object to be cooked, wherein the operating mode of the air-direction regulator is manually determined by a user's input operation, or is automatically determined according to the kind of the object to be cooked.

8. The apparatus according to claim 1, wherein the dispersive discharge mode comprises a variable dispersive discharge mode to cause turbulent flows in the cooking chamber by changing a hot air feeding position.

9. A cooking apparatus comprising:

a cooking chamber;

a hot-air feeder to feed hot air into the cooking chamber;

at least one air-direction regulator to change a direction of the hot air fed from the hot-air feeder, the air-direction regulator having an operating mode comprising a concentrative discharge mode to concentrate the hot air fed from the hot-air feeder to a specific region in the cooking chamber and a dispersive discharge mode to widely disperse the hot air in the cooking chamber, wherein the dispersive discharge mode comprises a variable dispersive discharge mode to cause turbulent flows in the cooking chamber by changing a hot air feeding position, the hot-air feeder comprises a plurality of discharge holes, and the at least one air-direction regulator comprises a plurality of air-direction regulators provided at the plurality of discharge holes, respectively, and the plurality of air-direction regulators independently change a hot air feeding direction, to further cause turbulent flows in the cooking chamber.

10. The apparatus according to claim 1, further comprising:

a display unit to display the operating mode of the air-direction regulator.

11. A cooking apparatus comprising:

a cooking chamber;

a divider to divide the cooking chamber into a plurality of cooking spaces;

a hot-air feeder having a fan cover formed with a plurality of discharge holes to feed hot air into each of the plurality of cooking spaces;

an air-direction regulator to change a direction of the hot air to be discharged from the plurality of discharge holes, the air-direction regulator having an operating mode comprising a concentrative discharge mode to concentrate the hot air fed from the hot-air feeder to a specific region in the cooking chamber and a dispersive discharge mode to widely disperse the hot air in the cooking chamber;

a sensing unit to sense a position of an object to be cooked in the cooking chamber; and a control unit to control the air-direction regulator, so as to close the plurality of discharge holes, or to regulate the direction of the hot air to be discharged, wherein, in the concentrative discharge mode, the control unit controls the air-direction regulator to concentrate the direction of the hot air to the position of the object sensed by the sensing unit in response to a signal from the sensing unit.

12. The apparatus according to claim 11, wherein the plurality of cooking spaces include first and second cooking chambers; and the air-direction regulator comprises an upper air-direction regulator to change the direction of the hot air to be discharged into the first cooking chamber, and a lower air-direction regulator to change the direction of the hot air to be discharged into the second cooking chamber.

13. The apparatus according to claim 12, wherein the control unit controls the respective upper and lower air-direction regulators independently.

14. The apparatus according to claim 13, wherein the control unit controls one of the upper and lower air-direction regulators, to prevent the hot air from being discharged into one of the first and second cooking chambers, to which no cooking command is inputted, when a cooking command is inputted to the other cooking chamber.

15. A method for controlling a cooking apparatus comprising a cooking chamber, a hot-air feeder to feed hot air into the cooking chamber, and an air-direction regulator to change a direction of the hot air, the method comprising:

determining an operating mode based on inputted cooking information; and regulating the direction of the hot air discharged from the hot-air feeder based on the operating mode;

using a sensing unit to sense a position of an object to be cooked in the cooking chamber if the operating mode corresponds to a concentrative discharge mode to concentrate the hot air to a predetermined region; and if the position of the object to be cooked is sensed, concentrating the hot air discharged from the hot-air feeder to the sensed position of the object to be cooked by use of the air- direction regulator in response to a signal form the sensing unit.

16. The method according to claim 15, further comprising:

if the operating mode corresponds to a dispersive discharge mode to achieve a uniform temperature distribution in the cooking chamber, uniformly dispersing the hot air discharged from the hot-air feeder into the cooking chamber by use of the hot-air regulator.

17. The method according to claim 15, further comprising:

displaying whether the interior of the cooking chamber is in the concentrative discharge mode or in the dispersive discharge mode by operation of the air-direction regulator.

18. The apparatus according to claim 1, further comprising:

one or more guide units formed along sides of the cooking chamber, each guide unit being configured to support a tray in the cooking chamber, wherein the sensing unit comprises at least three weight sensors positioned on the one or more guide units.

* * * * *